US008523559B2

(12) United States Patent
Suljak et al.

(10) Patent No.: US 8,523,559 B2
(45) Date of Patent: Sep. 3, 2013

(54) HEAT RETAINING HOOD ASSEMBLIES, AIR CURTAIN DESTRUCTORS WITH HEAT RETAINING HOOD ASSEMBLIES, AND METHODS FOR USING THE SAME

(75) Inventors: Clifford Michael Suljak, Mesa, AZ (US); David Michael Rosenberg, Phoenix, AZ (US)

(73) Assignee: Hood & Motor Technology, LLC, Cincinnati, OH (US)

( * ) Notice: Subject to any disclaimer, the term of this patent is extended or adjusted under 35 U.S.C. 154(b) by 0 days.

(21) Appl. No.: 12/985,810

(22) Filed: Jan. 6, 2011

(65) Prior Publication Data

US 2011/0165524 A1 Jul. 7, 2011

Related U.S. Application Data

(60) Provisional application No. 61/292,710, filed on Jan. 6, 2010.

(51) Int. Cl.
*F24C 15/20* (2006.01)

(52) U.S. Cl.
USPC ..... 431/2; 126/299 D; 126/299 R

(58) Field of Classification Search
USPC ..... 431/2; 126/299 D, 299 R; 454/49, 454/63, 65, 67
See application file for complete search history.

(56) References Cited

U.S. PATENT DOCUMENTS

| | | | | |
|---|---|---|---|---|
| 3,897,721 | A | 8/1975 | Fuhst | |
| 4,023,473 | A | 5/1977 | Russell | |
| 4,031,819 | A | 6/1977 | Applewhate | |
| 4,421,094 | A * | 12/1983 | Crane et al. | 126/61 |
| 4,700,688 | A | 10/1987 | Searcy et al. | |
| 4,756,258 | A | 7/1988 | Gilbert | |
| 5,359,990 | A * | 11/1994 | Hsu | 126/299 E |
| 6,752,710 | B2 * | 6/2004 | Shore et al. | 454/49 |
| 7,214,349 | B2 * | 5/2007 | Holst et al. | 422/169 |
| 7,645,432 | B1 | 1/2010 | Solomon | |

OTHER PUBLICATIONS

Search Report and Written Opinion dated Nov. 15, 2011 as it relates to PCT/US2011/020190.

* cited by examiner

*Primary Examiner* — Alfred Basichas
(74) *Attorney, Agent, or Firm* — Dinsmore & Shohl LLP

(57) ABSTRACT

Heat retaining hood assemblies include a plenum with an interior side and an exterior side, wherein the plenum restricts heat from flowing from the interior side to the exterior side, and an exhaust duct fluidly connected to the exterior side of the plenum, wherein the plenum includes one or more contours to direct the exhaust on the interior side to an intake opening of the exhaust duct, and wherein the exhaust flows from the intake opening to a release vent of the exhaust duct disposed on the exterior side of the plenum.

17 Claims, 10 Drawing Sheets

HEAT RETAINING HOOD ASSEMBLIES, AIR CURTAIN DESTRUCTORS WITH HEAT RETAINING HOOD ASSEMBLIES, AND METHODS FOR USING THE SAME

CROSS-REFERENCE TO RELATED APPLICATIONS

This application claims priority to U.S. Provisional Patent Application Ser. No. 61/292,710 filed Jan. 6, 2010 which is incorporated by reference herein.

TECHNICAL FIELD

The present specification generally relates to hood assemblies and, more specifically, heat retaining hood assemblies for air curtain destructors.

BACKGROUND

Air curtain destructors can be used to burn various materials ("fuel") including wood, bio-mass, organic materials, solid and/or processed wastes (e.g., municipal solid waste) and/or other carbon based materials (e.g., coal). The fuel may be loaded into an inner cavity of the air curtain destructor and ignited, such as by using an accelerant. An air curtain is then provided at the inner cavity to suppress the amount of smoke and particulate matter ("PM") that leaves the air curtain destructor. However, heat and some exhaust can still escape from the open top of the air curtain destructor potentially decreasing the efficiency of the combustion and increasing the amount of pollutants escaping to the surrounding environment.

Accordingly, a need exists for alternative hood assemblies for air curtain destructors to retain heat and direct exhaust.

SUMMARY

In one embodiment, a heat retaining hood assembly that retains heat and directs exhaust is provided. The heat retaining hood assembly includes a plenum with an interior side and an exterior side, wherein the plenum restricts heat from flowing from the interior side to the exterior side. The heat retaining hood assembly further includes an exhaust duct fluidly connected to the exterior side of the plenum, wherein the plenum includes one or more contours to direct the exhaust on the interior side to an intake opening of the exhaust duct, and wherein the exhaust flows from the intake opening to a release vent of the exhaust duct disposed on the exterior side of the plenum.

In another embodiment, an air curtain destructor is provided that includes a firebox having an inner cavity formed from a plurality of sides and a centrifugal blower that blows a curtain of air across a top of the inner cavity. The air curtain destructor further includes a heat retaining hood assembly having a plenum with an interior side that faces towards the inner cavity and an exterior side that faces away from the inner cavity, wherein the plenum substantially covers an open top of the inner cavity such that when a fuel is burned within the inner cavity, and the centrifugal blower blows the curtain of air across the top of the inner cavity, the heat retaining hood assembly retains heat within the inner cavity.

In yet another embodiment, a method for burning fuels in an air curtain destructor, is provided. The method includes placing a fuel in an inner cavity of the air curtain destructor, burning the fuel in the inner cavity, flowing air across the top of the inner cavity to create a turbulent vortex that prevents large particulate matter from the burning fuel from escaping the inner cavity, covering at least a portion of a top opening of the air curtain destructor with a heat retaining hood assembly such that the heat retaining hood assembly retains heat within the inner cavity, and directing exhaust from the burning fuel along one or more contours of the heat retaining hood assembly away from the air curtain destructor.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
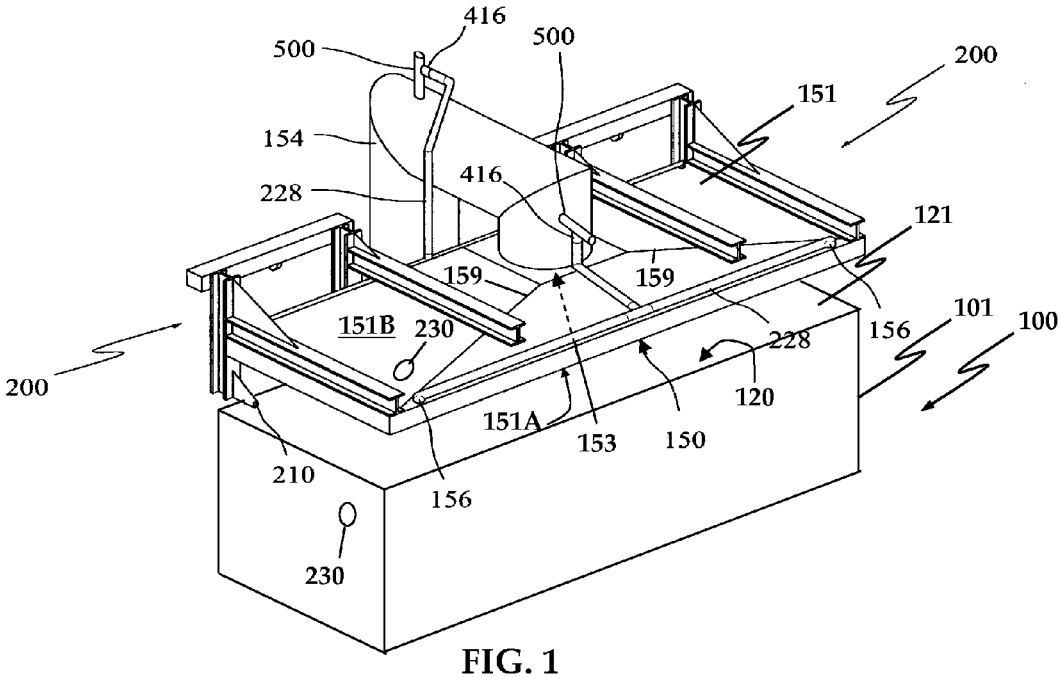
FIG. 1 depicts an exemplary heat retaining hood assembly above an air curtain destructor according to one or more embodiments shown and described herein.

The present disclosure relates to heat retaining hood assemblies that can be incorporated with air curtain destructors to produce heat retaining air curtain destructors that may be used for the burning of various materials ("fuel"). As used herein, "fuel" refers to any material or combinations of materials that can be burned within an air curtain destructor such as, for example, wood, bio-mass, organic materials, solid and/or processed wastes (e.g., municipal solid waste), and/or other carbon based materials (e.g., coal). The heat retaining hood assembly may generally comprise a plenum to cover all or part of the top opening of the air curtain destructor. Specifically, the heat retaining hood assembly can comprise an interior side to conform to the top opening of the air curtain destructor to help restrain heat from flowing outside of the air curtain destructor (so that heat is retained in the inner cavity of the air curtain destructor). In addition, the heat retaining hood assembly can comprise an exhaust duct and one or more contours to direct the exhaust from the inner cavity of the air curtain destructor to the exterior of the air curtain destructor. The inclusion of a heat retaining hood assembly may thereby assist in a more efficient burning of fuel by retaining more heat within the inner cavity of the air curtain destructor. In some embodiments, the heat retaining hood assembly may reduce the emission of coarse particulate matter, such as PM 2.5/10 airborne particulate matter, into the surrounding atmosphere and environment that is created in the disposal and/or major volumetric reduction of green vegetative organic wastes via pyrotechnic combustion.

Referring now to FIGS. 1-3 and 9, a heat retaining hood assembly 150 may include a plenum 151 configured to substantially cover an open top 121 of an interior cavity of a firebox 101 of an air curtain destructor 100. The heat retaining hood assembly 150 can retain heat within the air curtain destructor 100, which can increase the rate at which fuel may be burned. As used herein, "retain heat" means reduce the amount of heat lost to the outside environment that would occur if the heat retaining hood assembly 150 were not present. The plenum 151 of the heat retaining hood assembly 150 can comprise any substantially continuously solid structure that can retain heat on one side of the plenum and comprise one or more contours to direct exhaust from the same side in which the heat is being retained. Heat may be retained by restricting the amount of heat that flows from one side of the heat retaining hood assembly 150 to the other. In some exemplary embodiments, the heat retaining hood assembly 150 may also provide additional surface area to which one or more heat exchangers (such as for the production of steam or other forms of fluid expansion to a gaseous state) may be mounted to withdraw heat (which may be referred to as "waste heat") from the air curtain destructor 100.

The plenum 151 of the heat retaining hood assembly 150 comprises an interior side 151A that faces the inner cavity of the firebox 101 of an air curtain destructor 100 when in operation, and an exterior side 151B that faces the external environment of the air curtain destructor 100 when in operation. In some exemplary embodiments, the plenum 151 may comprise one or more contours 159 to direct exhaust on the interior side 151A of the plenum 151. For example, in some embodiments, the plenum 151 can comprise a truncated rectangular pyramid (see, e.g., FIG. 1 wherein the exhaust duct is fluidly connected to a top portion of the truncated pyramid), a triangular prism (see, e.g., FIG. 2), a right triangle, arch, hexagon, and/or any other suitable geometric or non geometric shape (see, e.g., FIG. 3). The plenums 151 of the heat retaining hood assemblies 150 may thus be configured to collect and/or retain heat, and/or may collect and/or direct the flow of exhaust in any direction away from the firebox 101.

In some embodiments, the heat retaining hood assembly 150 further comprises an exhaust duct 154 fluidly connected to the heat retaining hood assembly 150 (such as being fluidly connected to the plenum 151. As used herein, "fluidly connected" means connected such that exhaust fumes travel from the heat retaining hood assembly 150 into the exhaust duct 154 without substantial loss of exhaust to the outside environment at the connection. The exhaust duct 154 can be fluidly connected to the exterior side 151B of the plenum 151 and receive exhaust directed by the plenum 151 in an intake opening 153 and direct it out a release vent 152 disposed on the exterior side of the plenum 151 (or on the exterior of the air curtain destructor 100). As such, some exemplary heat retaining hood assemblies 150 may include an exhaust duct 154 to provide an exhaust flow path from plenum 151. For example, exhaust duct 154 may fluidly connect to plenum 151 at a substantially central higher portion. In some embodiments, exhaust duct 154 may generally form an inverted J-shape (as illustrated in FIG. 1) such that exhaust from the air curtain destructor 100 is conveyed initially upwards from the plenum 151, then laterally across and away from the plenum 151, and then downward relative to the plenum 151. In some exemplary embodiments, exhaust duct 154 may have a generally circular cross section. In some exemplary embodiments, exhaust duct 154 may include, or may convey exhaust gasses to other components that include, exhaust treatment and/or filtration devices, which may remove undesirable constituents of the exhaust prior to discharge into the atmosphere and/or other useful thermal and/or environmental process streams.

Figure 2:
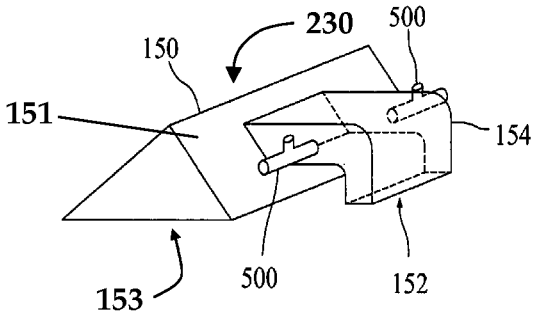
FIG. 2 depicts another exemplary heat retaining hood assembly according to one or more embodiments shown and described herein.
Figure 3:
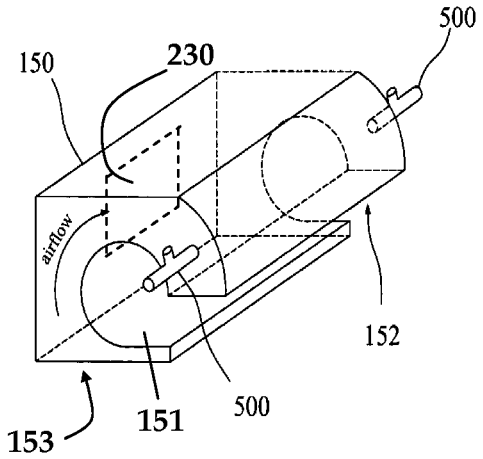
FIG. 3 depicts yet another exemplary heat retaining hood assembly according to one or more embodiments shown and described herein.
Figure 4:
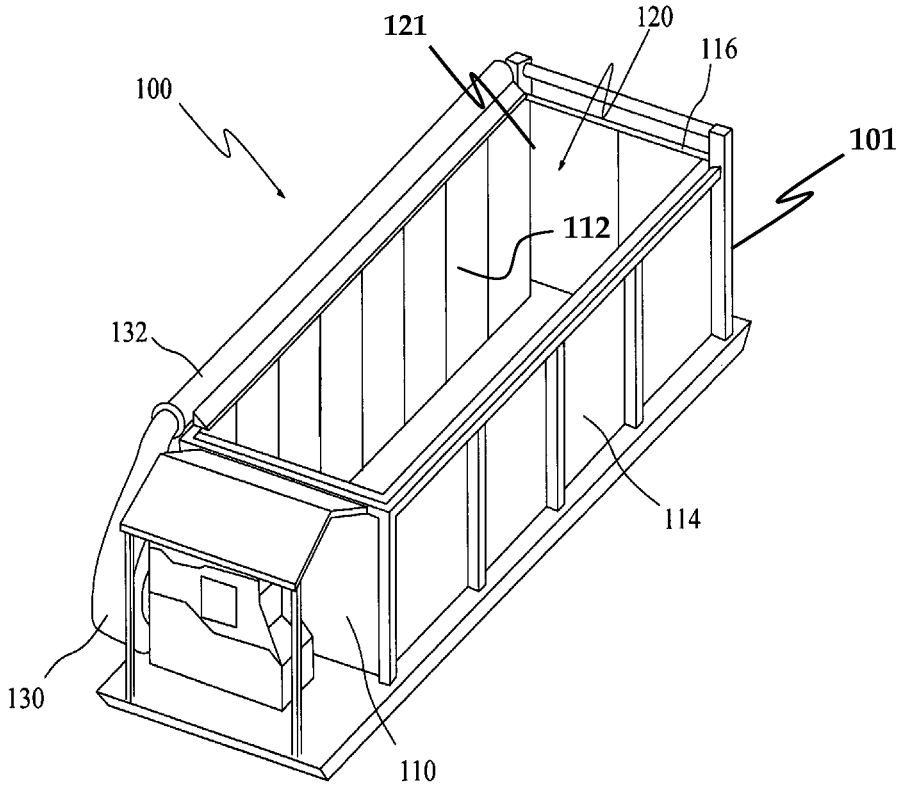
FIG. 4 depicts an exemplary air curtain destructor according to one or more embodiments shown and described herein.

FIGS. 2 and 3 illustrate alternative embodiments for the heat retaining hood assembly 150. For example, in the heat retaining hood assembly 150 illustrated in FIGS. 2 and 9, the heat retaining hood assembly 150 has an exhaust duct 154 that extends away from the heat retaining hood assembly 150 and directs the exhaust gases in such a way that they exhaust in a downward direction through the release vent 152. In the heat retaining hood assembly 150 illustrated in FIG. 3, the exhaust duct is configured to circularly redirect the rising exhaust back in a downwards direction and out the release vent 152. While specific configurations of heat retaining hood assemblies 150 and exhaust ducts 154 are illustrated in FIGS. 1-3, it should be appreciated that these are not limiting configurations and alternative designs can be additionally or alternatively incorporated.

In some embodiments, such as those illustrated in FIGS. 1-3, the exhaust duct 154 can have one or more openings through which fluid (e.g., water and/or other various liquid emission remediation concentrates) can be sprayed using a fluid venturi nozzle 500. For example, in some embodiments the fluid sprayed through the fluid venturi nozzle 500 can comprise one or more elements in an aqueous solution to help capture particulates from the exhaust. The fluid venturi nozzle 500 can be equipped with a sprayer to finely disperse the fluid/air mixture that exits the fluid venturi nozzle. As this finely dispersed fluid/air mixture is sprayed into the exhaust duct 154, fine particulates in the exhaust gases can adhere to the fluid droplets and/or saturated steam molecules. The exhaust gases can then exit the release vent 152 to the atmosphere and/or other processes, and the fluid droplets, along with any particulates adhering to them, fall downward from the release vent 152 where the fluid can be collected and/or filtered. In some embodiments, the fluid venturi nozzles 500 can be configured so that their air intake port 416 draws air from beneath the heat retaining hood assembly 150 via holes 156 and ducts 228. By allowing the fluid venturi nozzles 500 to draw their intake air from beneath the heat retaining hood assembly 150, escape of exhaust around the edges of the heat retaining hood assembly 150 can be minimized.

Figure 5:
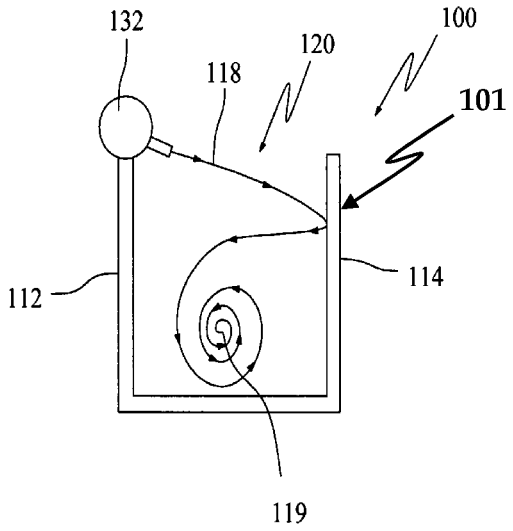
FIG. 5 depicts an exemplary cross-sectional view of a turbulent vortex in an air curtain destructor according to one or more embodiments shown and described herein.

Referring now to FIGS. 4-7, exemplary air curtain destructors 100 (such as a S-Series Firebox Refractory Walled Air Curtain Burner available from Air Burners LLC) are illustrated which can be used in connection with exemplary heat retaining hood assemblies according to the present disclosure. The air curtain destructor 100 can comprise a firebox 101 having a plurality of sides 110, 112, 114, and 116 defining an inner cavity 120 (which may also be referred to as a combustion chamber) in which fuel may be burned such as garbage, wood, and/or other fuel as discussed herein. A centrifugal blower 130 blows air through a duct 132 that is mounted longitudinally along the top of one side 112 of the air curtain destructor 100. As best illustrated in FIG. 5, the air exits the duct 132 such that the air stream is directed across the top of the air curtain destructor 100 toward the opposing side 114 of the air curtain destructor 100. The resulting air currents forms a "curtain" 118 of air flowing across the top of the inner cavity 120 of the air curtain destructor 100, as well as a turbulent vortex 119 of air within the air curtain destructor 100. The air curtain 118 prevents large particulate matter from escaping, and the turbulent vortex 119 allows the fuel being burned (e.g., wood, garbage, etc) to reach a higher temperature and burn more completely, thus reducing emissions of volatile organic compounds and other pollutants.

Figure 6:
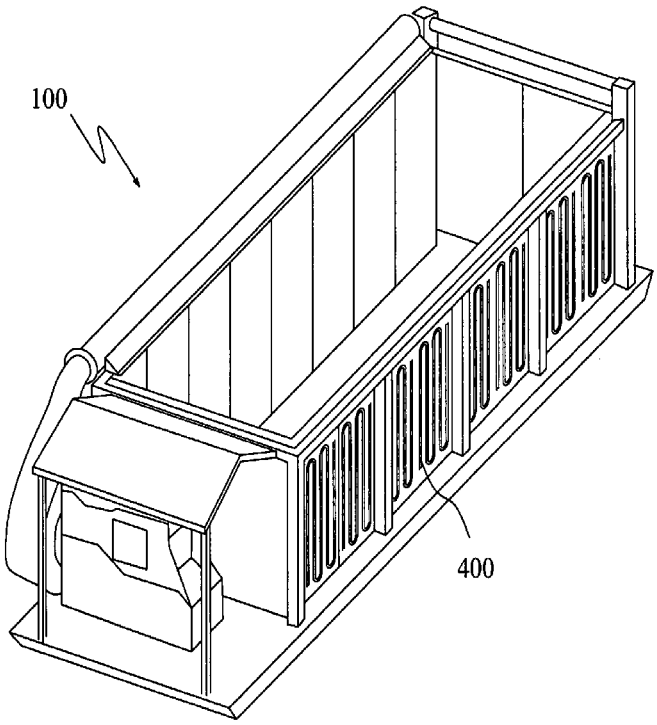
FIG. 6 depicts an exemplary air curtain destructor with heat exchangers according to one or more embodiments shown and described herein.
Figure 7:
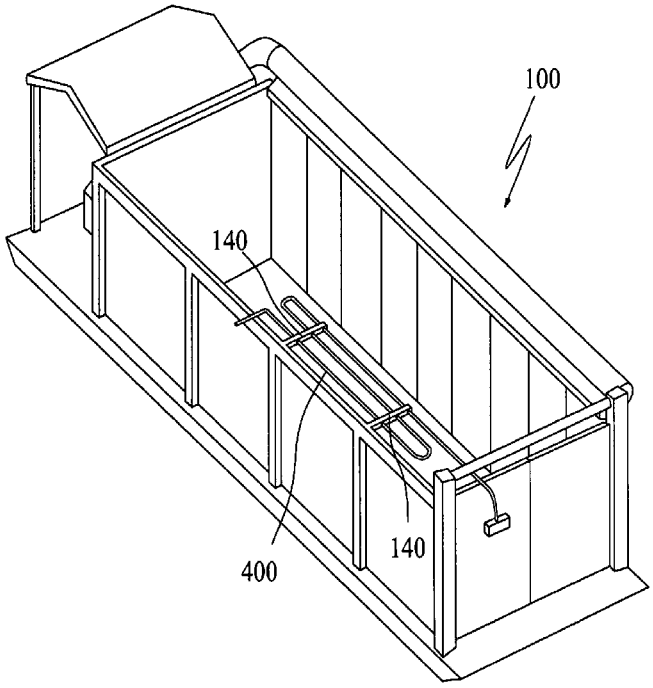
FIG. 7 depicts another exemplary air curtain destructor with heat exchangers according to one or more embodiments shown and described herein.

As illustrated in FIGS. 6 and 7, heat exchangers 400 (such as evaporator coils as illustrated) can be joined to one or more locations of the air curtain destructor 100 by a plurality of brackets 140 or the like, or may alternatively be an integral part of the combustion chamber panel. For example, FIG. 6 illustrates an embodiment wherein the heat exchangers are disposed on one side of the air curtain destructor 100. FIG. 7 illustrates an embodiment wherein the heat exchangers 400 are mounted on a bracket 140 above the air curtain destructor 100. This configuration can allow for higher temperatures reaching the heat exchanger 400, thus increasing the rate at which energy can be transferred to the heat exchanger 400. As fuel such as wood and/or garbage is burned in the air curtain destructor 100, some of the heat generated is transferred to the heat exchanger 400, it can generate energy within the heat exchanger (such as by heating the water/fluids in evaporator coils to generate steam/gaseous states). In this manner, some of the heat generated as a result of burning fuel in the air curtain destructor 100 can be used to generate steam. The energy (e.g., steam) produced in the heat exchanger 400 may then be used for various purposes, such as industrial purposes related to thermal transfer and water purification.

Figure 8:
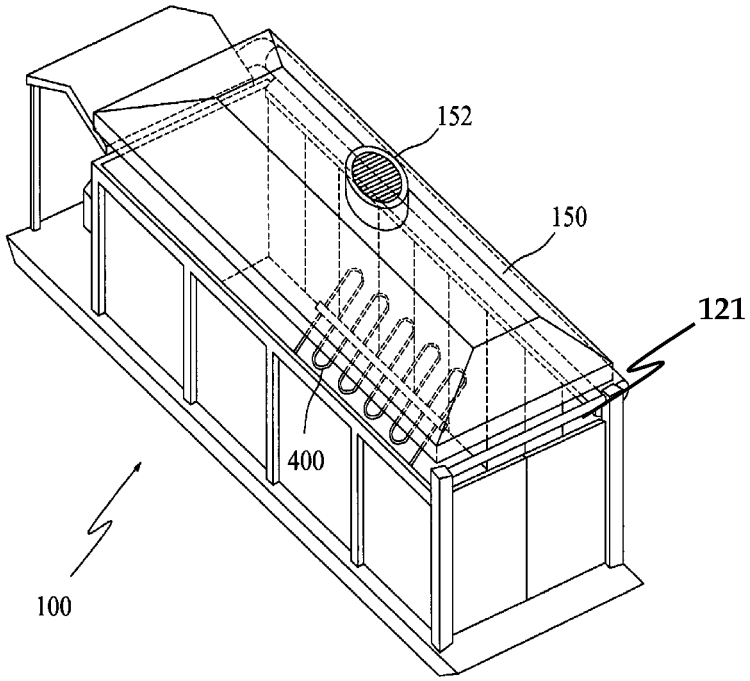
FIG. 8 depicts an exemplary air curtain destructor with a heat retaining hood assembly according to one or more embodiments shown and described herein.
Figure 9:
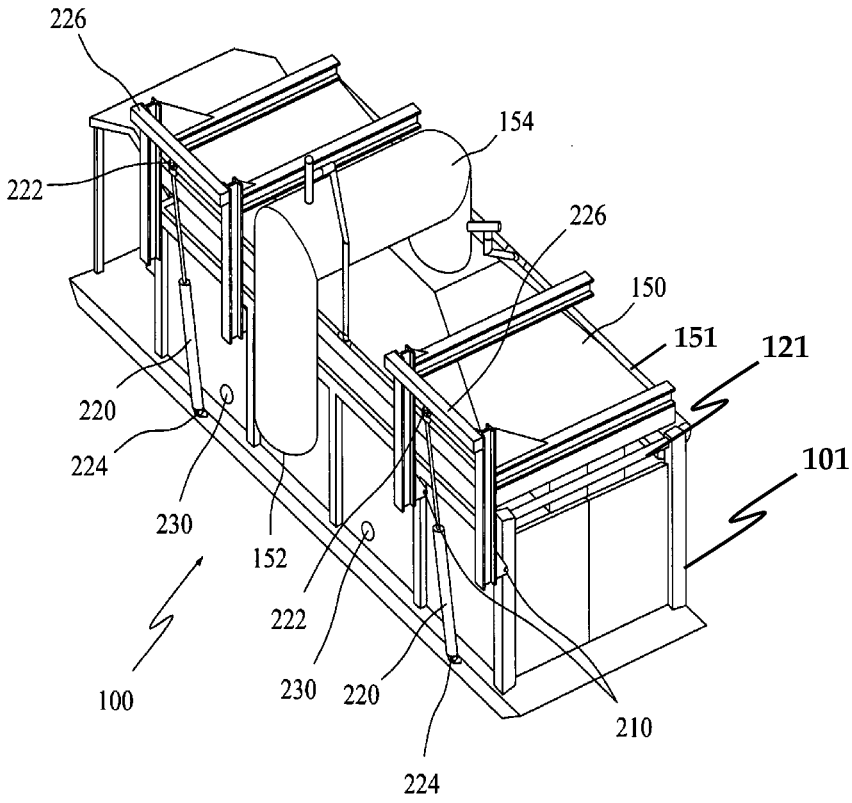
FIG. 9 depicts an exemplary air curtain destructor with a heat retaining hood assembly in a closed position according to one or more embodiments shown and described herein.
Figure 10:
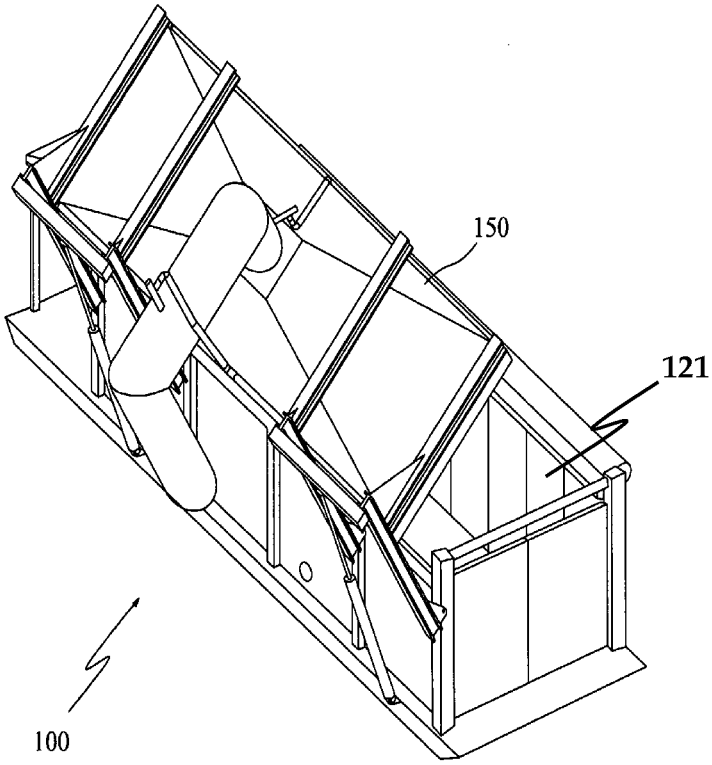
FIG. 10 depicts an exemplary air curtain destructor with a heat retaining hood assembly in an open position according to one or more embodiments shown and described herein.

Referring now to FIGS. 8-10, heat retaining hood assemblies 150 connected with air curtain destructors 100 are illustrated. As illustrated, the heat retaining hood assemblies 150 can be positioned to substantially cover an open top 121 of the air curtain destructor 100 (e.g., over the open top 121 of the firebox 101). As such, heat produced from the burning of fuel within the air curtain destructor 100 will be retained and, where an exhaust duct 154 is present, exhaust can be collectively directed and potentially filtered and/or processed in various manners to limit the amount of pollutants/greenhouse gasses released to the surrounding environment.

In some embodiments, the heat retaining hood assembly 150 can retain heat around the heat exchanger to increase its efficiency such as when the heat exchanger 400 is mounted at an angle above the air curtain destructor 100 (as illustrated in FIG. 6). For example, as illustrated in FIG. 8, the heat retaining hood assembly 150 can partially surround the heat exchanger 400 and be positioned above the air curtain destructor 100 such that the heat retaining hood assembly 150 collects exhaust gases rising from the air curtain destructor 100. This collection of exhaust gases by the heat retaining hood assembly 150 allows the exhaust gases to be concentrated in an area surrounding the heat exchanger 400 for a longer duration, resulting in more energy being transferred from the exhaust gases to the heat exchanger 400. A release vent 152 allows the exhaust gases to flow out of the heat retaining hood assembly 150. As illustrated in FIGS. 6 and 7, a plurality of heat exchangers 400 can alternatively or additionally be positioned above or around the air curtain destructor 100, and a plurality of brackets 140 can hold the heat exchangers 400 in place. Where the heat exchangers 400 comprise evaporator coil units (as illustrated in FIGS. 6-8) water and/or other fluids can be injected into the evaporator coil units using one or more fluid venturi nozzles or other liquid medium supply devices.

Referring now to FIGS. 1, 9 and 10, in some embodiments, the heat retaining hood assembly 150, or at least the plenum 151, may be hingedly connected to an air curtain destructor 100 such that at least a portion of the plenum 151 may be pivoted closed to retain heat (as illustrated in FIG. 9) and pivoted open to allow additional fuel to be deposited within the air curtain destructor 100 (as illustrated in FIG. 10). For example, in some exemplary embodiments, the heat retaining hood assembly 150 comprises one or more hydraulic cylinders 220 connected to the plenum 151 and adjacent structures at one or more points 222, 224. This can allow the plenum 151 to be opened (as illustrated in FIG. 10) and/or shut (as illustrated in FIG. 9) using one or more hydraulic cylinders 220 arranged to articulate plenum 151 relative to an open top 121 of the air curtain destructor 100. Some exemplary heat retaining hood assemblies 150 may include appropriate hinge/actuator articulation hardware. Some exemplary heat retaining hood assemblies 150 may be configured to permit the addition of fuel via access ports 230 to the inner cavity 120 of the air curtain destructor 100 without articulating the plenum 151, as illustrated in FIGS. 1-3.

As illustrated in FIGS. 1, 9 and 10, in some embodiments, the heat retaining hood assembly 150 can be joined to the air curtain destructor 100 via a framework 200 made of steel or other suitable material affixed to the heat retaining hood assembly 150. In such embodiments, the framework 200 is pivotally joined to the air curtain destructor at attachment points 210. Hydraulic cylinders 220 can be joined to the framework 200 at framework connection points 222 and to the air curtain destructor at additional connection points 224. This allows the hydraulic cylinders to apply a downward force to the rearward beams 226 of the framework 200, which causes the framework 200 and heat retaining hood assembly 150 to rotate about the attachment points 210. The heat retaining hood assembly 150 can thereby be rotated into a raised position (as illustrated in FIG. 10), which allows access to the interior of the air curtain destructor 100.

Referring now to FIG. 9, in operation, the heat retaining hood assembly 150 is positioned in close proximity to the open top 121 of the air curtain destructor 100. This placement of the heat retaining hood 150 allows most of the exhaust gases from the inner cavity 120 to be collected by the heat retaining hood assembly 150. Some exemplary embodiments may include fluid injectors, such as fluid venturi nozzles 500 (each of which can be equipped with a sprayer) in the exhaust duct 154 to inject fluid spray into the exhaust duct 154 to capture particulates in the exhaust gases. The exhaust gases exit the release vent 152 of the exhaust duct 154 to the atmosphere, and the fluid droplets, along with any particulates adhering to them, fall downward from the release vent 152, where the fluid can be collected and filtered and/or directed to other processes. Some exemplary heat retaining hood assemblies may be used with an air curtain destructor 100 to which heat exchangers 400 have been affixed, as discussed above (and as illustrated in FIG. 8). Additionally, oxygen, or a mixture of oxygen and air or other gases and fuels, can be pumped into the air curtain destructor 100 through ports 230 to aid combustion.

While the embodiments described herein comprise a single heat retaining hood assembly 150 with a single air curtain destructor 100, it should be appreciated that the relative size and number of heat retaining hood assemblies 150 and air curtain destructors 100 can be adjusted to provide additional embodiments. For example, in some embodiments, the scale of the heat retaining hood assembly 150 may be increased with respect to the air curtain destructor 100 such that a single heat retaining hood assembly 150 can cover a plurality of air curtain destructors. These embodiments can additionally allow for an increase in the amount and/or size of heat exchangers 400 to allow for a greater power output. In some embodiments, multiple heat retaining hood assemblies 150 may be incorporated with a single air curtain destructor. In some embodiments, multiple heat retaining hood assemblies 150 and multiple air curtain destructors 100 may be incorporated.

The heat retaining hood assemblies 150 described herein can be used in conjunction with air curtain destructors 100 to burn a variety of fuels. For example, some exemplary heat retaining hood assemblies 150 may be used in the disposal of fuel including known and/or suspected hazardous materials (e.g., asbestos, which may be present in certain vintages of building construction debris). Although the definition of a hazardous material may be highly subjective and/or may vary dramatically by agency, municipality, state and federal regulations or lists, exemplary heat retaining hood assemblies 150 according to the present disclosure may be useful in connection with many such hazardous materials. For example, some exemplary heat retaining hood assemblies 150 may allow certain hazardous materials to be burned (disposed of) within an air curtain destructor 100 with acceptable air quality concentration discharge levels being emitted to the atmosphere and/or ancillary process streams.

In some embodiments, a heat retaining hood assembly 150 that comprises contours 159 that direct exhaust to an exhaust duct 154 can be used to reduce the amount of "Black Carbon" (airborne particulate matter in the range of 2.5 to 10 microns in diameter), greenhouse gases or other unwanted discharge into the atmosphere by directing, filtering and/or collecting it as it leaves the air curtain destructor 100. By effectively expanding the range of substances which may be disposed of via an air curtain destructor 100 to include some hazardous materials, the use of some heat retaining hood assemblies 150 according to the present disclosure may reduce the amount of Black Carbon emitted by disposal operations.

Additionally, the present disclosure contemplates that some materials may be major contributors to the production of undesirable greenhouse gases (e.g., methane) during their normal decay processes. For example, methane may be about 20 times more hazardous to the environment than carbon dioxide, so the disposal of some methane-producing materials via an air curtain destructor 100 with a heat retaining hood assembly 150 may increase the combustion rate and decrease the amount of methane to the environment by collecting it as it leaves an exhaust duct 154. As discussed herein, heat retaining hood assemblies 150 according to the present disclosure may increase the efficiency and/or reduce emissions from air curtain destructors 100, which may also include the reduction of $CO_2$ through various techniques.

It should now be appreciated that heat retaining hood assemblies may trap heat and/or make the air curtain destructor burn hotter, which may result in higher through-put than an open chambered air curtain destructor. In some embodiments according to the present disclosure, the hood may further provide additional surface area for heat exchangers to capture the waste heat. In some embodiments according to the present disclosure, the hood may be used to direct the exhaust flow for process filtration of particulates and/or to collect waste heat which may be used for ancillary waste heat purposes, such as, but not limited to, electric power production.

While exemplary embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages may exist even though they may not have been explicitly discussed herein.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An air curtain destructor comprising:

a firebox having an inner cavity formed from a plurality of sides;

a centrifugal blower that blows a curtain of air across a top of the inner cavity;

one or more ports that allow the introduction of one or more fuels into the inner cavity; and a heat retaining hood assembly configured to retain heat and direct exhaust, the heat retaining hood assembly comprising:

at least one plenum having a contoured shape and comprising an intake opening, an interior side, and an exterior side, wherein the plenum is configured to restrict heat from flowing from the interior side to the exterior side; and at least one exhaust duct fluidly connected to the plenum and comprising a release vent; wherein the heat retaining hood assembly includes an exhaust flowpath having a curvature defined by the contoured shape of the plenum, the exhaust flowpath extending from the intake opening of the plenum to the release vent;

wherein the plenum substantially covers an open top of the inner cavity such that when a fuel is burned within the inner cavity, and the centrifugal blower blows the curtain of air across the top of the inner cavity, the heat retaining hood assembly retains heat within the inner cavity.

2. The air curtain destructor of claim 1, wherein the contoured shape of the plenum comprises a substantially truncated pyramid.

3. The air curtain destructor of claim 1, further comprising one or more fluid injectors disposed in the exhaust duct.

4. The air curtain destructor of claim 3, wherein the fluid injectors are fluid venturi nozzles.

5. The air curtain destructor of claim 3, wherein the one or more fluid injectors are disposed more proximate to the release vent of the exhaust duct than the intake opening of the plenum.

6. The air curtain destructor of claim 1, wherein the exhaust duct comprises an inverted J-shape such that the exhaust within the inner cavity is conveyed initially upwards from the plenum, then laterally across and away from the plenum, and then downward relative to the plenum.

7. The air curtain destructor of claim 1, further comprising a plurality of fireboxes such that the interior side of the plenum faces towards a plurality of inner cavities.

8. The air curtain destructor of claim 1, wherein a framework pivotally connects the heat retaining hood assembly to the air curtain destructor such that at least a portion of the plenum can be pivotally opened.

9. The air curtain destructor of claim 8, wherein the framework comprises one or more hydraulic cylinders that pivotally open at least the portion of the plenum.

10. An air curtain destructor comprising:

a firebox having an inner cavity formed from a plurality of sides;

a centrifugal blower that blows a curtain of air across a top of the inner cavity;

a heat retaining hood assembly configured to retain heat and direct exhaust, the heat retaining hood assembly comprising:

at least one plenum having a contoured shape and comprising an intake opening, an interior side, and an exterior side, wherein the plenum is configured to restrict heat from flowing from the interior side to the exterior side; and at least one exhaust duct fluidly connected to the plenum and comprising a release vent; wherein the heat retaining hood assembly includes an exhaust flowpath having a curvature defined by the contoured shape of the plenum, the exhaust flowpath extending from the intake opening of the plenum to the release vent;

wherein the plenum substantially covers an open top of the inner cavity such that when a fuel is burned within the inner cavity, and the centrifugal blower blows the curtain of air across the top of the inner cavity, the heat retaining hood assembly retains heat within the inner cavity and a framework pivotally connects the heat retaining hood assembly to the air curtain destructor such that at least a portion of the plenum can be pivotally opened.

11. The air curtain destructor of claim 10, wherein the framework comprises one or more hydraulic cylinders that pivotally open at least the portion of the plenum.

12. The air curtain destructor of claim 10, further comprising a plurality of fireboxes such that the interior side of the plenum faces towards a plurality of inner cavities.

13. The air curtain destructor of claim 10, wherein the contoured shape of the plenum comprises a substantially truncated pyramid.

14. The air curtain destructor of claim 10, further comprising one or more fluid injectors disposed in the exhaust duct.

15. The air curtain destructor of claim 14, wherein the fluid injectors are fluid venturi nozzles.

16. The air curtain destructor of claim 14, wherein the one or more fluid injectors are disposed more proximate to the release vent of the exhaust duct than the intake opening of the plenum.

17. The air curtain destructor of claim 10, wherein the exhaust duct comprises an inverted J-shape such that the exhaust within the inner cavity is conveyed initially upwards from the plenum, then laterally across and away from the plenum, and then downward relative to the plenum.

* * * * *